US008448793B2

(12) United States Patent
Barron

(10) Patent No.: US 8,448,793 B2
(45) Date of Patent: May 28, 2013

(54) FRAMED JEWELRY WALL ORGANIZER

(76) Inventor: Donna Ann Barron, Pineville, LA (US)

( * ) Notice: Subject to any disclaimer, the term of this patent is extended or adjusted under 35 U.S.C. 154(b) by 26 days.

(21) Appl. No.: 13/136,123

(22) Filed: Jul. 25, 2011

(65) Prior Publication Data

US 2013/0026119 A1 Jan. 31, 2013

(51) Int. Cl.

| | |
|---|---|
| ***A47F 7/02*** | (2006.01) |
| *A47F 7/14* | (2006.01) |
| *A47F 3/00* | (2006.01) |
| *A47G 29/00* | (2006.01) |
| *B65D 1/24* | (2006.01) |

(52) U.S. Cl.

USPC ..... 211/85.2; 211/50; 211/72; 312/114; 220/507; 206/6.1

(58) Field of Classification Search

USPC ..... 211/13.1, 85.2, 45, 50, 55, 71.01, 211/72, 87.01; 220/480, 507, 503, 555; 206/6.1, 206/566; 312/245, 114, 242

See application file for complete search history.

(56) References Cited

U.S. PATENT DOCUMENTS

| | | | | | |
|---|---|---|---|---|---|
| 2,109,586 | A | * | 3/1938 | Einbinder | 359/855 |
| 3,249,217 | A | * | 5/1966 | Irving | 206/461 |
| 3,371,439 | A | * | 3/1968 | Smith et al. | 40/735 |
| 4,326,546 | A | * | 4/1982 | Acker | 132/314 |
| 4,616,755 | A | * | 10/1986 | Adolfsson | 211/87.01 |
| 4,685,568 | A | * | 8/1987 | Elsfelder | 206/561 |
| 4,687,103 | A | * | 8/1987 | Corbett | 206/566 |
| 4,767,011 | A | * | 8/1988 | Butler | 211/85.2 |
| 4,905,821 | A | * | 3/1990 | Corbett | 206/45.24 |
| 4,923,069 | A | * | 5/1990 | Germain et al. | 211/85.2 |
| D312,018 | S | * | 11/1990 | Giesy | D6/571 |
| D316,673 | S | * | 5/1991 | Rysner et al. | D9/415 |
| 5,050,745 | A | * | 9/1991 | Sanders | 211/85.2 |
| 5,141,300 | A | * | 8/1992 | Ciesla | 312/204 |
| 5,172,814 | A | * | 12/1992 | Pell et al. | 211/85.2 |
| 5,209,344 | A | * | 5/1993 | Smith | 206/6.1 |
| 5,253,750 | A | * | 10/1993 | Keffer | 206/6.1 |
| 5,273,153 | A | * | 12/1993 | Braun | 206/561 |
| 5,511,653 | A | * | 4/1996 | Ovadia | 206/6.1 |
| D380,496 | S | * | 7/1997 | Meyer | D19/90 |
| 5,645,178 | A | * | 7/1997 | Conley, Jr. | 211/87.01 |
| 5,823,360 | A | * | 10/1998 | Gorosave | 211/13.1 |
| 5,950,815 | A | * | 9/1999 | Yetman-Bellows | 206/6.1 |
| 6,209,734 | B1 | * | 4/2001 | Wang | 211/87.01 |
| 6,884,081 | B1 | * | 4/2005 | Ovadia | 434/386 |
| 6,929,552 | B1 | * | 8/2005 | Hargabus | 472/61 |
| 7,008,029 | B1 | * | 3/2006 | Aclin | 312/245 |
| 7,905,362 | B2 | * | 3/2011 | Slimane | 211/13.1 |
| 2002/0145365 | A1 | * | 10/2002 | Johnson et al. | 312/114 |
| 2003/0234185 | A1 | * | 12/2003 | Flagg | 206/6.1 |

(Continued)

*Primary Examiner* — Joshua J Michener
*Assistant Examiner* — Devin Barnett

(57) ABSTRACT

A framed jewelry wall organizer for storing and displaying jewelry is disclosed. This organizer is encased in a decorative frame. The central opening of the frame holds a fabricated clear, hard, plastic sheet with clear, hard, open top, rounded plastic cups on the front side of the sheet. Vacuum forming or injection molding creates this clear plastic sheet with clear cups and makes it one plastic unit. This clear plastic unit is then placed in the frame. A mat or mirror is then sandwiched behind the clear plastic sheet to add design. The mat or mirror can be clearly seen behind the transparent plastic sheet. Finally, a cardboard backing fits behind the mat or mirror and picture frame points are inserted to hold all of the components in the frame. The framed unit will be hung on a wall with picture frame hardware.

3 Claims, 5 Drawing Sheets

U.S. PATENT DOCUMENTS

2006/0070892 A1* 4/2006 Benson ..... 206/6.1
2006/0180481 A1* 8/2006 McGaughey ..... 206/6.1
2007/0170126 A1* 7/2007 Singer et al. ..... 211/55
2008/0185299 A1* 8/2008 Thorman ..... 206/6.1
2009/0212056 A1* 8/2009 Degorl ..... 220/507
2010/0155266 A1* 6/2010 Nicholson ..... 206/6.1
2010/0170810 A1* 7/2010 Shulman ..... 206/6.1
2010/0308701 A1* 12/2010 Haine et al. ..... 312/114

* cited by examiner

FIG. 6
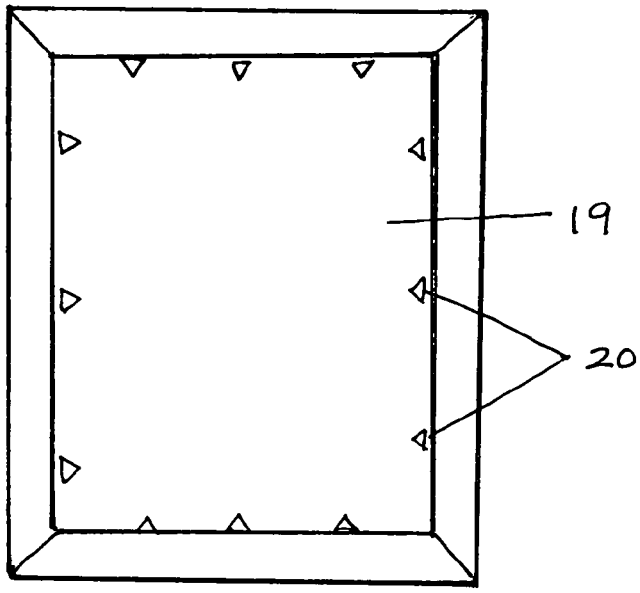
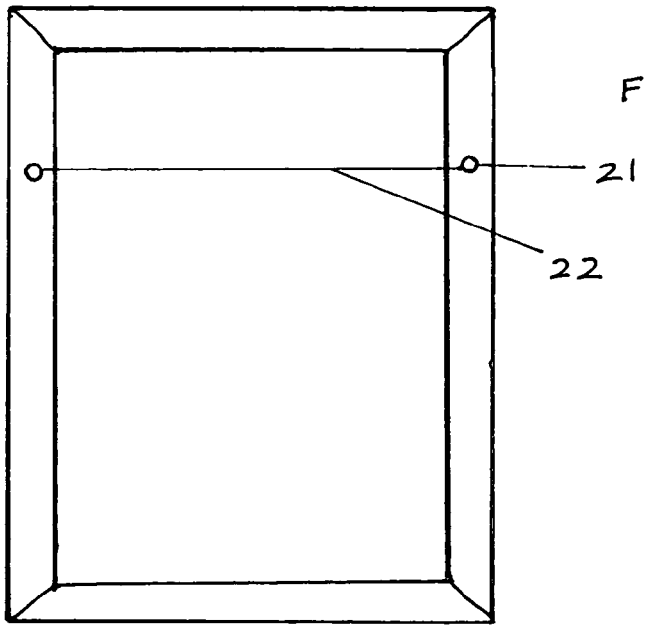
FIG. 7

FRAMED JEWELRY WALL ORGANIZER

CROSS-REFERENCED TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPACT DISC APPENDIX

Not Applicable

BACKGROUND OF THE INVENTION

This invention relates to the field of jewelry storage and this device provides a means of organizing and displaying all types of jewelry in such a manner that all of the jewelry can be visible at all times.

In the past, many attempts have been made to provide display units capable of organizing and displaying items, such as jewelry, in a convenient, attractive device that keeps jewelry clearly visible, separated, and quickly accessible.

Such attempts have met some requirements while missing others. Many jewelry boxes, drawers, cabinets, or furniture have moving parts that can be a hinderance and break easily. While they can sometimes be pleasing aesthetically, they do not allow for every type of jewelry to be visible at all times. Keeping jewelry paired and in matching sets can also be burdensome.

Storage devices with collapsible pockets and wire mesh offer more visibility of some types of jewelry, but retrieval of jewelry is not quick and easy. These devices for storage are also not aesthetically pleasing.

The prior art is replete with references that attempt to address these concerns, where such prior art is exemplified by the following U.S. patents:

A.) U.S. Pat. No. 7,008,029, to Aclin, discloses a wall suspendible cabinet for storing and displaying jewelry items, especially of the type for storing and displaying earrings having a looped hook, or a post and lock. The cabinet comprises a first section and at least a second section hinged thereto, pivotal from an open or jewelry displayed mode, to a closed or storage mode. The respective sections, along the inside faces thereof, includes means for suspending such jewelry items. One such means comprises a pleated mesh having a mesh face lying against a section backing face, and a series of laterally oriented, meshed flaps extending from the mesh face.

B.) U.S. Pat. No. 5,050,745, to Sanders, a holder for both clip-on and pierced earrings is disclosed herein having a frame mounting a net or screen about it's edge marginal region and a loop-like leash attached to the top of the frame. Clip-on earrings are attached to the leash while pierced earrings couple to the net in a random display. The edge marginal regions of the net are adhesively secured to a recessed shoulder on the back of the frame. A mat is employed to cover the edge marginal region and to provide reinforcement.

C.) U.S. Pat. No. 5,172,814, to Pell et al., is directed to a board for holding and displaying jewelry consisting of a base and a plurality of removable and replaceable jewelry holding bracelets adapted to support on an individual basis clip type earrings for pierced ears, bracelets, necklaces, finger rings and pins. A special holder for supporting hair barrettes, such as used by little girls, is also adapted to be included or utilized with the board. The particular number of each type of support unit and their arrangement thereon can be determined by the user. Each of the elements for holding jewelry with the exception of an included pin pad and a shelf for supporting finger rings, can be removed and replaced on an as-desired basis.

D.) U.S. Pat. No. 5,209,344, to Smith, is a collapsible, foldable jewelry organizer and storage device capable of being hung from a closet rod or protrusion, which renders the jewelry objects stored thereby individually visible to the user, is disclosed. The device comprises a flexible substratum having a plurality of flexible transparent or translucent pockets within which jewelry objects may be stored. The pockets may be of various sizes and may be arranged in a matrix configuration. The substratum is supported from the bottom edge of a hanger by means of the interaction of the bottom edge of the hanger with a tube extending around the bottom edge of the hanger. The tube is attached to the substratum along the top edge of the substratum allowing the device to be hung from a closet rod or similar protrusion.

While the foregoing prior art offer some convenience to the user thereof, especially women who want to store jewelry items, none present a custom designed decorative device that is wall hung to store all types of jewelry, singularly or in sets, which can be seen all at one time and quickly retrieved, with no movable or collapsible parts.

BRIEF SUMMARY OF THE INVENTION

It is the object of this invention to improve organization for displaying and storing all types of jewelry.

It is the object of this invention to keep jewelry easily seen and paired allowing for quick retrieval of an item.

Another object of this invention is to keep jewelry untangled, paired if necessary, and in good condition.

Yet another objective is to reduce clutter of jewelry boxes and furniture by hanging the organizer on the wall.

Still another object of the present design is the ability to see all jewelry at all times in the clear plastic cups.

Still another object of this invention is to create an organizer that can be adapted to any person male or female and designed for any age.

Yet another object of the present invention is to keep any matching jewelry sets together.

Still another object of this invention is to create a decorative jewelry organizer that adds to the décor of a room.

It is the further object of this invention to create a design with no moving parts that can break.

Finally, it is the object to eliminate collapsible jewelry pockets, wire mesh, or drawers that make visibility and retrieval difficult.

These and other objects of the present invention are attained by this organizer for displaying and storing pieces of jewelry that include a frame, a fabricated clear plastic sheet with clear open top rounded plastic cups, and a mat or mirror behind the plastic sheet to ad to the design. This unit is made to be hung on a wall with picture frame hardware.

BRIEF DESCRIPTION OF THE DRAWINGS

FIG. 6 shows the back of the organizer with a cardboard backing that is secured with picture frame points to hold all of the parts in place;

FIG. 7 illustrates picture frame hardware to hang the invention on the wall.

DETAILED DESCRIPTION OF THE INVENTION

Figure 1:
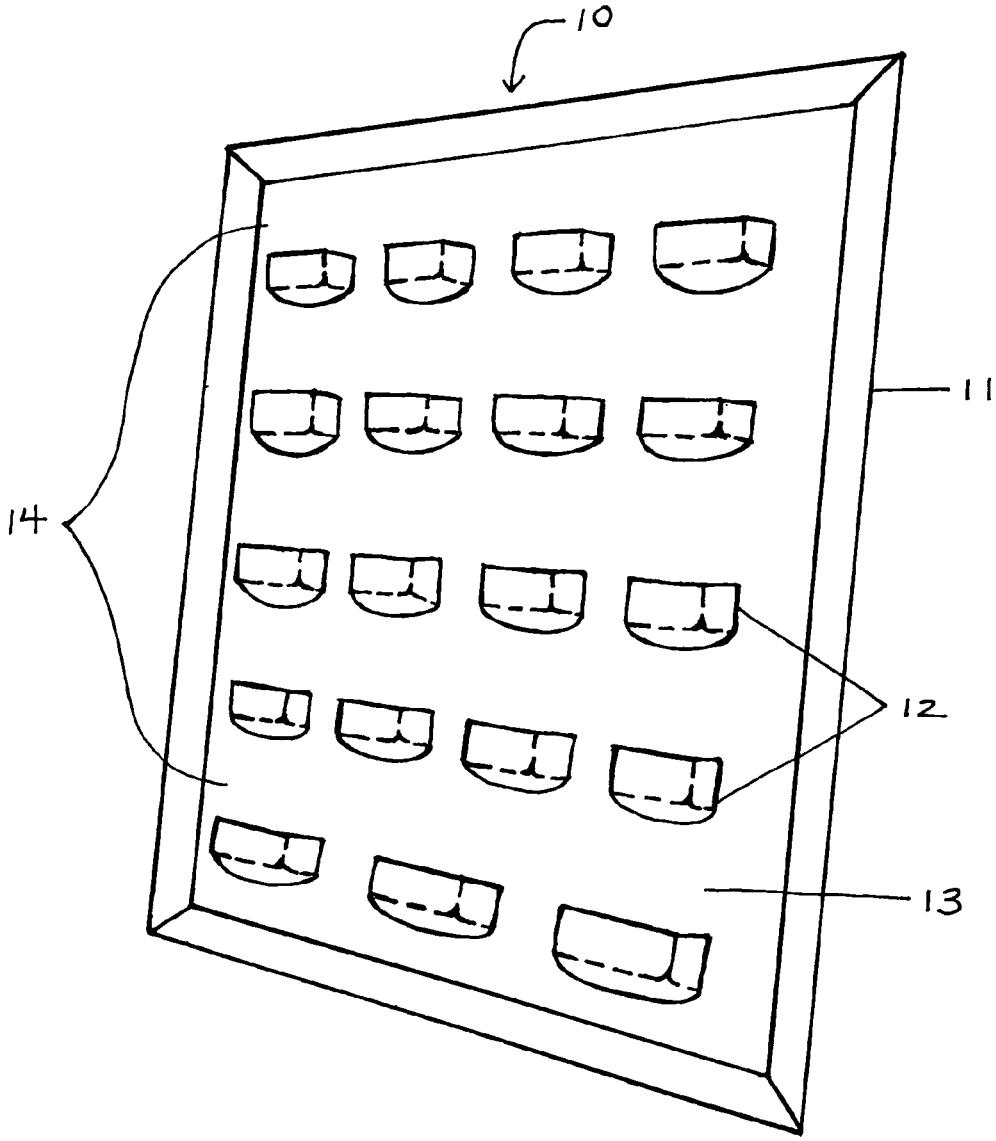
FIG. 1 is a front perspective view illustrating the framed jewelry wall organizer.

Referring to FIG. 1, the framed jewelry wall organizer of the present invention is illustrated in the general direction of arrow 10 which includes a frame 11 having top and bottom linear members attached at their opposite ends to opposite ends of side linear members so that a central area is defined between the opposing surfaces or edges of the members. The frame 11 can be made of wood, plastic, or metal and be of any color or size. The opening central area consists of clear, hard, open top plastic cup units 12 molded with a clear hard backing 13 making one continuous sheet 14 that is secured in the frame 11. The number of cup units 12 vary depending on the overall size of the wall organizer. Jewelry will be easily seen at all times and organized in the clear, open top cup units 12.

Figure 2:
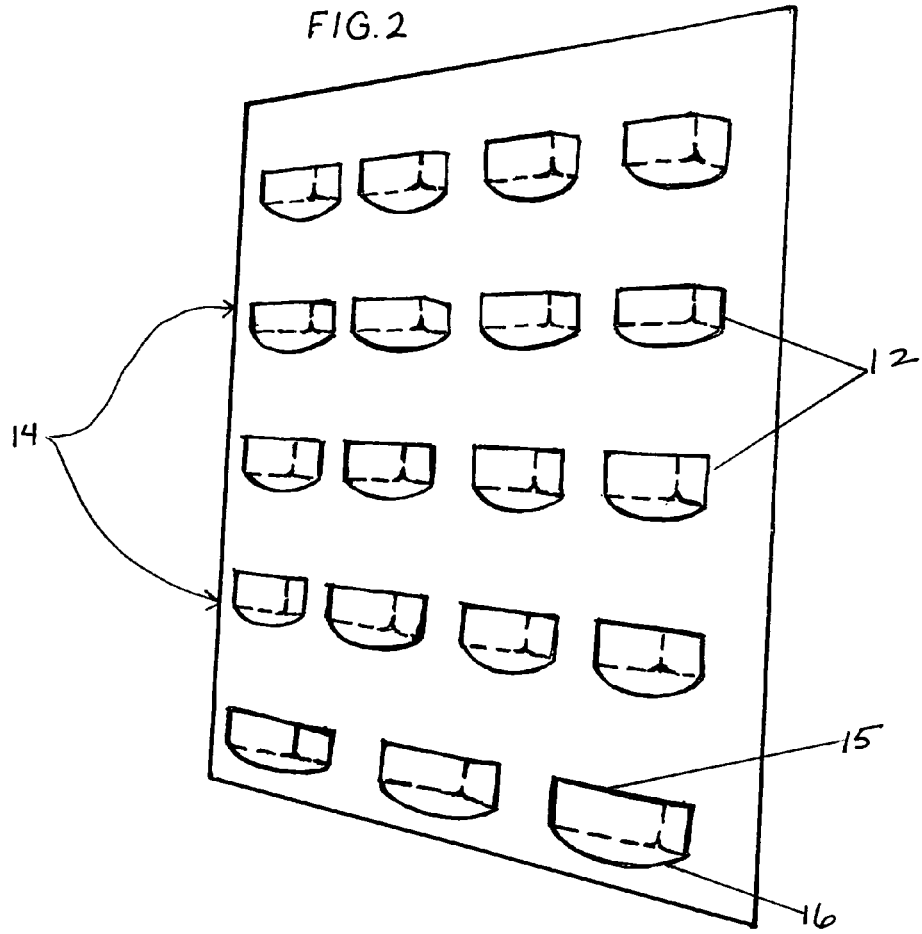
FIG. 2 is a front perspective view illustrating the clear, hard, plastic sheet with the molded clear, hard, plastic, open top cups with rounded bottom corners. This illustration shows one complete plastic unit that includes cups molded into a plastic back.

Referring now in detail to FIG. 2, it can be seen that the clear plastic sheet with the cup units is vacuum formed or injection molded into one continuous sheet 14 with protruding, clear, open top, cups 12 to allow for display of any type of jewelry. The cups are rectangular in shape with the longer ends of the rectangle at the top and bottom. The sides are the shorter length. with rounded bottom corners. The top of the rectangle shaped cup is open 15 and the bottom corners are rounded. The curvature 16 of the cups is essential to keep small items quickly and easily retrievable and to avoid small earrings from stacking in corners. The size of the cups may vary on the fabricated sheet. Some cups may be smaller and adapt better for earrings and rings, while other cups may be larger to accommodate sets of jewelry, watches, bracelets and large necklaces.

Figure 3:
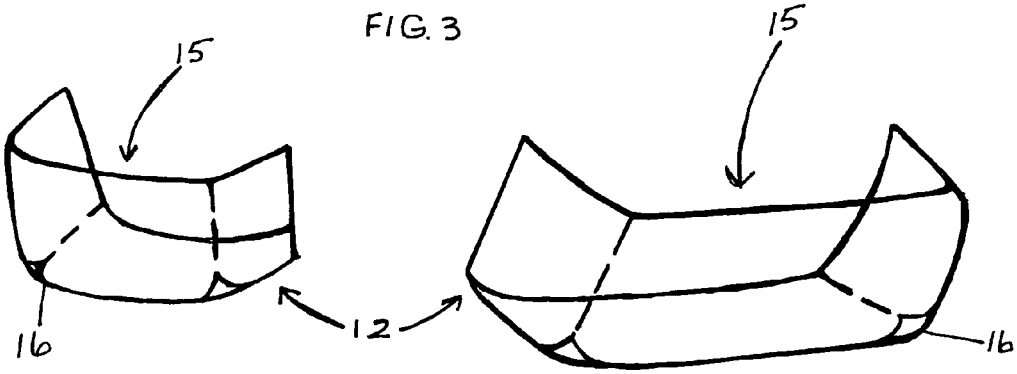
FIG. 3 is a three dimensional drawing showing the curvature of the clear, hard plastic cups that is fabricated by vacuum forming or injection molding into a complete plastic unit.

FIG. 3 is a three dimensional drawing showing the curvature 16 of the clear hard plastic cups 12 and the open top 15 of the cups allowing for deposit and retrieval of an item.

Figure 4:
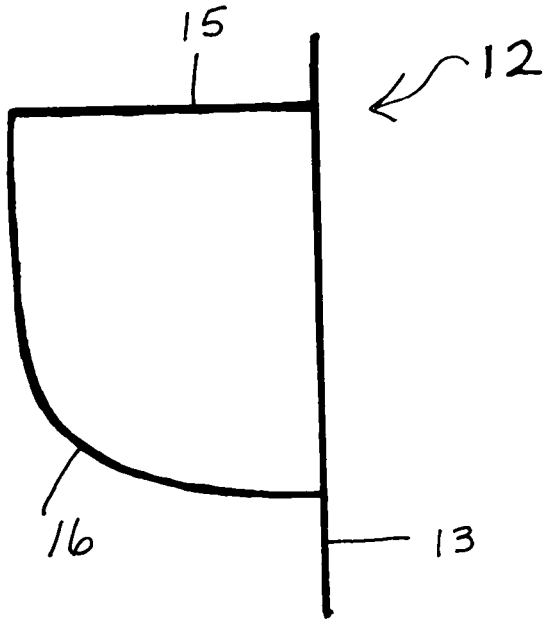
FIG. 4 is a side view of the clear rounded cups with the open top showing the protrusion or extension of the cup from the backing.

FIG. 4 is a side view showing the protrusion of the cup unit 12 from the plastic back 13. The open top 15 of the cup 12 is also shown. The curvature 16 of the cups is also evident from this view.

Figure 5:
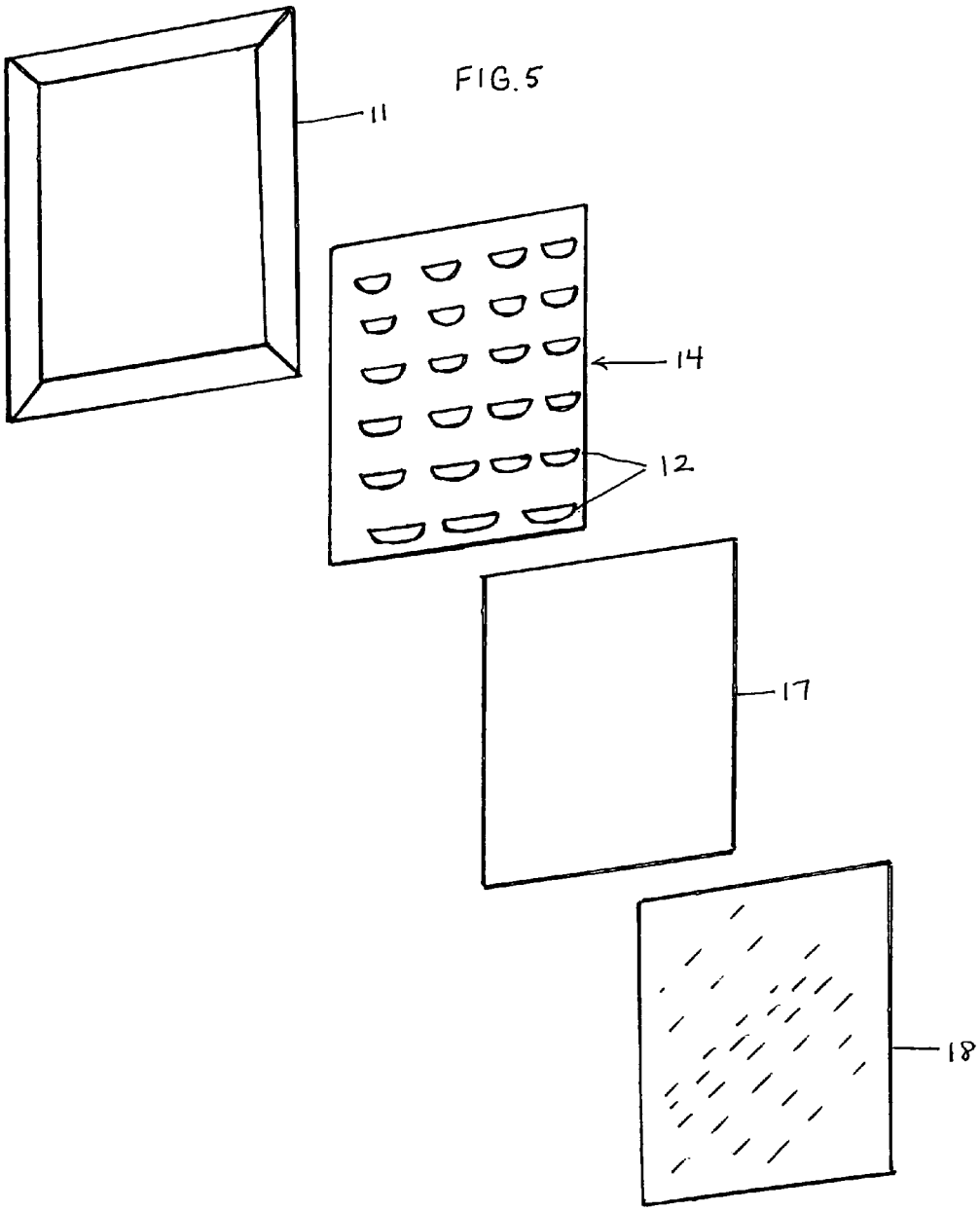
FIG. 5 is an exploded view of the framed jewelry wall organizer showing the parts involved and the order of construction of the invention.

FIG. 5 is an exploded view of the organizer showing the decorative frame 11 following with the fabricated plastic sheet 14 with the molded cups 12. A mat 17 will then be placed behind the clear plastic fabricated sheet 14. This allows for personalized mat design to match any décor for male or female, and for any age. Because this is clearly seen behind the fabricated plastic sheet 14, an alternate embodiment of a mirror 18 can be used in place of the mat 17. A mirror 18 can be used to give the person his or her reflection to put on the jewelry. A cardboard backing 19 will finish the back of the organizer.

In FIG. 6 a cardboard backing 19 will finish the back of the organizer. The entire framed organizer will then be secured by picture frame points 20.

Finally, FIG. 7 includes picture frame hanging screws 21 and wire 22 to hang the organizer on the wall. The screws 21 will be screwed into the frame and the wire 22 will go through the eye of the picture screws.

While particular embodiments of this invention have been shown and described, it will be obvious to those skilled in the art that changes and modifications may be made without departing from this invention in its broader aspects and; therefore, the aim in the appended claim is to cover all changes and modifications as they fall within the true spirit and scope of this invention.

What is claimed is:

1. A framed wall organizer for displaying and storing jewelry comprising:

a frame comprising top, bottom, and two side members, said top and bottom members joined at opposite ends with said side members to define a central opening area; a planar backing member;

a mirror;

a clear non-collapsible plastic sheet comprising a plurality of clear non-collapsible cups;

each of said plurality of clear non-collapsible of cups comprises two side walls, a front wall, a bottom, two bottom rounded corners, and an open top;

wherein said clear non-collapsible plastic sheet and said plurality of clear non-collapsible cups are vacuum formed or injection molded, thereby making a monolithic single plastic unit;

wherein said planar backing member is secured in said central opening and backing said mirror, and said mirror is backing said monolithic plastic single unit, thereby said planar backing member secures said mirror and said monolithic plastic single unit in said frame thereby making up a frame unit; and wherein said frame unit comprises a back portion, said back portion comprises hanging hardware attached thereto.

2. The framed wall organizer of claim 1, wherein said planar backing member is comprised of cardboard.

3. The framed wall organizer of claim 1, wherein said hanging hardware comprises keyhole screws and wire.

* * * * *